US010215165B2

(12) United States Patent
Lill

(10) Patent No.: US 10,215,165 B2
(45) Date of Patent: Feb. 26, 2019

(54) THERMAL-OPERATED PUMP

(71) Applicant: International Truck Intellectual Property Company, LLC, Lisle, IL (US)

(72) Inventor: Mark Paul Lill, Elgin, IL (US)

(73) Assignee: International Truck Intellectual Property Company, LLC, Lisle, IL (US)

( * ) Notice: Subject to any disclaimer, the term of this patent is extended or adjusted under 35 U.S.C. 154(b) by 602 days.

(21) Appl. No.: 14/784,738

(22) PCT Filed: Apr. 17, 2013

(86) PCT No.: PCT/US2013/036959
§ 371 (c)(1),
(2) Date: Oct. 15, 2015

(87) PCT Pub. No.: WO2014/171934
PCT Pub. Date: Oct. 23, 2014

(65) Prior Publication Data

US 2016/0061197 A1 Mar. 3, 2016

(51) Int. Cl.

| | |
|---|---|
| ***F04B 9/12*** | (2006.01) |
| ***F04B 9/123*** | (2006.01) |
| ***F04B 9/125*** | (2006.01) |
| ***F04B 19/22*** | (2006.01) |
| ***F04B 19/24*** | (2006.01) |
| ***F04B 31/00*** | (2006.01) |
| *F04B 39/12* | (2006.01) |

(52) U.S. Cl.
CPC ..... *F04B 19/22* (2013.01); *F04B 9/12* (2013.01); *F04B 9/123* (2013.01); *F04B 9/125* (2013.01); *F04B 19/24* (2013.01); *F04B 31/00* (2013.01); *F04B 39/121* (2013.01)

(58) Field of Classification Search
CPC . F04D 9/12; F04D 9/123; F04D 9/125; F04D 19/22; F04D 19/24; F04D 31/00; F04B 9/12; F04B 9/123; F04B 9/125; F04B 19/22; F04B 19/24; F04B 31/00
USPC ..... 417/51, 374, 379
See application file for complete search history.

(56) References Cited

U.S. PATENT DOCUMENTS

| | | | | |
|---|---|---|---|---|
| 2,389,067 A * | 11/1945 | Lieberman | ..... | F04B 9/12 417/379 |
| 2,976,675 A * | 3/1961 | Bonner | ..... | F02G 1/043 417/379 |
| 6,702,557 B2 * | 3/2004 | Kim | ..... | F04B 7/04 417/501 |

* cited by examiner

*Primary Examiner* — Peter J Bertheaud
(74) *Attorney, Agent, or Firm* — Jeffrey P. Calfa; Mark C. Bach

(57) ABSTRACT

A thermal operated fluid pump has a plunger which is moved by a thermally expandable element to compress a fluid, such as natural gas, into a storage cylinder.

6 Claims, 4 Drawing Sheets

THERMAL-OPERATED PUMP

TECHNICAL FIELD

This disclosure relates to a thermal-operated pump for returning vent gas, which has been contained in a vent gas containment space after having been vented from a gas storage vessel which stores gas at super-atmospheric pressure, back to the gas storage vessel from the vent gas containment space.

BACKGROUND

Combustion engines which propel certain motor vehicles, such as large truck vehicles, are fueled by natural gas. Natural gas is stored at super-atmospheric pressure in a vessel, a gas cylinder for example, as compressed natural gas (CNG). If pressure in a gas cylinder reaches a pressure limit, gas is vented from the gas cylinder into a vent gas containment space to prevent escape of the vent gas to the surrounding atmosphere.

SUMMARY OF THE DISCLOSURE

The present disclosure relates to a gas reclamation system for returning contained vent gas to a gas storage vessel which stores gas at super-atmospheric pressure and to a fluid pump which is useful as a gas reclamation pump in a gas reclamation system.

The gas reclamation system comprises a gas storage vessel which stores a gas, such as natural gas, at super-atmospheric pressure. A vent gas containment space contains vent gas which has been vented from the gas storage vessel.

A gas reclamation pump returns vent gas from the vent gas containment space to the gas storage vessel. The gas reclamation pump comprises a pump body comprising an inlet port and a bore having an outlet port.

An outlet flow path from the outlet port to the gas storage vessel comprises a check valve. An inlet flow path extends from the vent gas containment space to the inlet port.

The gas reclamation pump further comprises a plunger which is movable within the bore toward and away from the outlet port and which cooperates with a wall of the bore to define a variable volume space inward of the outlet port.

An element occupies the variable volume space and has a volume which increases with increasing difference between the element's actual temperature and an initial temperature.

The pump body further comprises an inlet passage coming from the inlet port to intercept the bore at a location which is traversed by the plunger during movement of the plunger within the bore.

A device in thermal energy transfer relationship with the element via the pump body causes the element to increase in volume with increasing difference between the element's actual temperature and an initial temperature and thereby increase the volume of the variable volume space by forcing the plunger to move along the bore toward the outlet port from within a first range of positions along which the plunger is beyond the location at which the inlet passage intercepts the bore relative to the outlet port for allowing vent gas in the vent gas containment space to flow through the inlet flow path and the inlet passage into a portion of the bore between the plunger and the outlet port, to traverse the location at which the inlet passage intercepts the bore for disallowing vent gas to flow into the bore, and then to move toward the outlet port along a second range of positions in a portion of the bore between the outlet port and the location at which the inlet passage intercepts the bore while continuing to disallow fluid flow from the inlet passage into the bore for forcing vent gas occupying a portion of the bore between the outlet port and the plunger toward the outlet port.

The foregoing summary, accompanied by further details of the disclosure, will be presented in the Detailed Description below with reference to the following drawings that are part of the disclosure.

DETAILED DESCRIPTION

Figure 1:
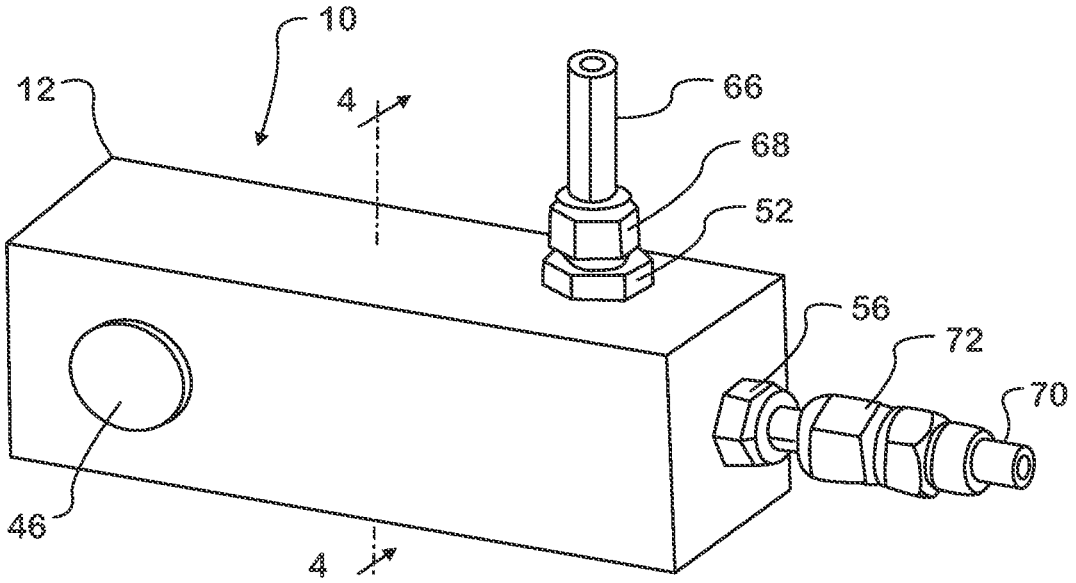
FIG. 1 is a perspective view of a fluid pump.

FIGS. 1-5 show a fluid pump 10 comprising a pump body 12 comprising a bore 14 which has an internal shoulder 16 separating a larger diameter cylindrical wall surface 18 and a smaller diameter cylindrical wall surface 20.

Pump body 12 further comprises an inlet port 22 and an outlet port 24. An inlet passage 26 extends inward of inlet port 22 to perpendicularly intercept bore 14 at a location along larger diameter cylindrical wall portion 18 spaced inward of outlet port 24 which is at one end of larger diameter cylindrical wall surface 18.

A plunger 28 is arranged for movement within bore 14 toward and away from outlet port 24. Plunger 28 comprises a cylindrical head 30 and a cylindrical stem 32. Plunger head 30 is arranged to move within a portion of larger diameter cylindrical wall surface 18 extending from internal shoulder 16 toward outlet 24. Plunger stem 32 is arranged to move within a portion of smaller diameter cylindrical wall surface 20 extending inward from internal shoulder 16. Plunger head 30 and plunger stem 32 form an external shoulder 34 facing internal shoulder 16 of bore 14 to define an inward limit of plunger movement away from outlet port 24 when external shoulder 34 abuts internal shoulder 16. Each of a pair of o-rings 36 is seated in a respective circular groove in a side surface of plunger head 30 adjacent opposite ends of plunger head 30 to provide a dynamic sealing of plunger head 30 to larger diameter cylindrical wall surface 18 throughout a range of movement of plunger 28 within bore 14 as will be more fully explained later.

Plunger stem 32 cooperates with smaller diameter cylindrical wall surface 20 of bore 14 to define a variable volume space 38 inward of outlet port 24. The volume of variable volume space 38 is a function of the position of plunger 28 within bore 14. An element 40 whose volume increases with increasing difference between the element's actual temperature and an initial temperature occupies variable volume space 38.

A device 42 is disposed in thermal energy transfer relationship with element 40 via pump body 12, which has good thermal conductivity, for causing element 40 to increase in volume with increasing difference between the element's actual temperature and an initial temperature and thereby increase the volume of variable volume space 38. The difference between the element's actual temperature and its initial temperature may increase either positively or negatively, meaning that the increase in volume of element 40 may occur as a consequence of either heating element 40 or cooling element 40 depending on the inherent nature of the material of element 40. One example of device 42 is an electric-operated heater 44 mounted on pump body 12. An external portion 46 of heater 44 is connected with an electric controller (not shown) for turning heater 44 on and off An internal portion 48 of heater 44 is disposed within a blind passage 50 extending from an exterior surface of pump body 12 toward element 40. The mounting of heater 44 on pump body 12 closes passage 50 opposite the blind end.

Figure 2:
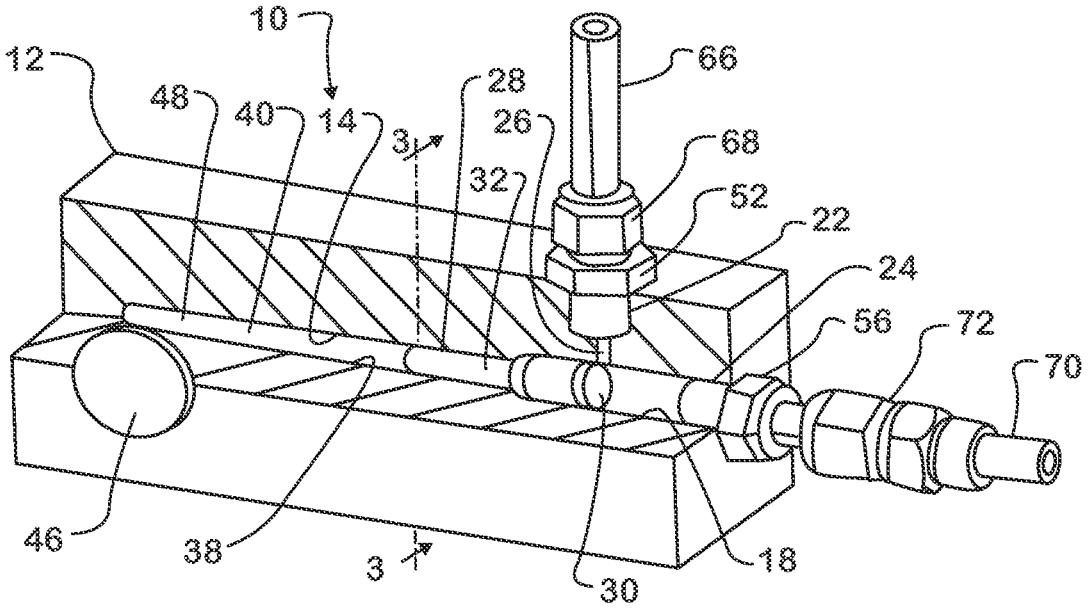
FIG. 2 is a perspective view like FIG. 1 but with a portion sectioned away.
Figure 3:
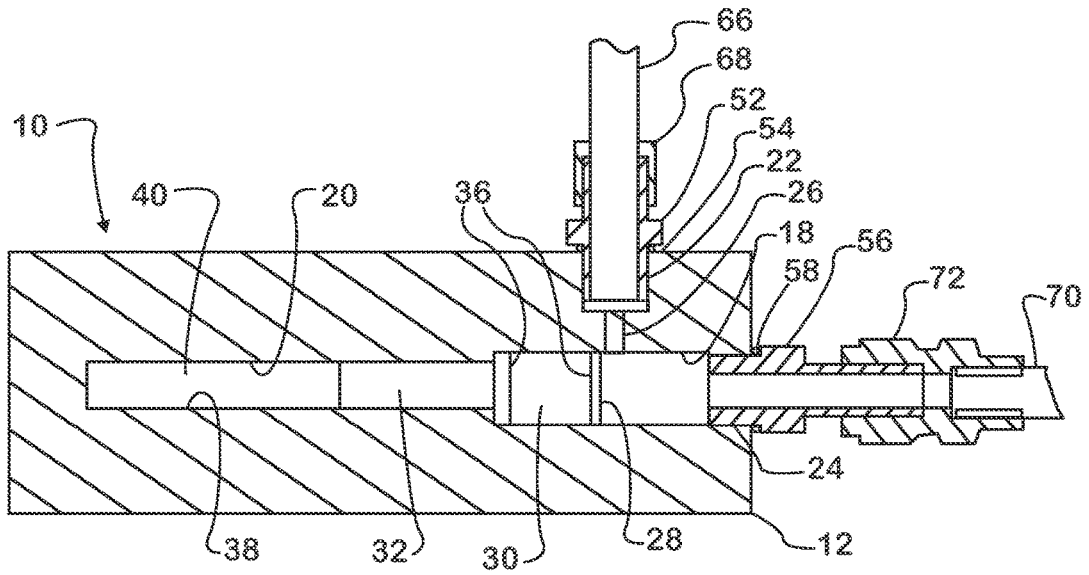
FIG. 3 is a cross section view in the direction of arrows 3-3 in FIG. 2
Figure 4:
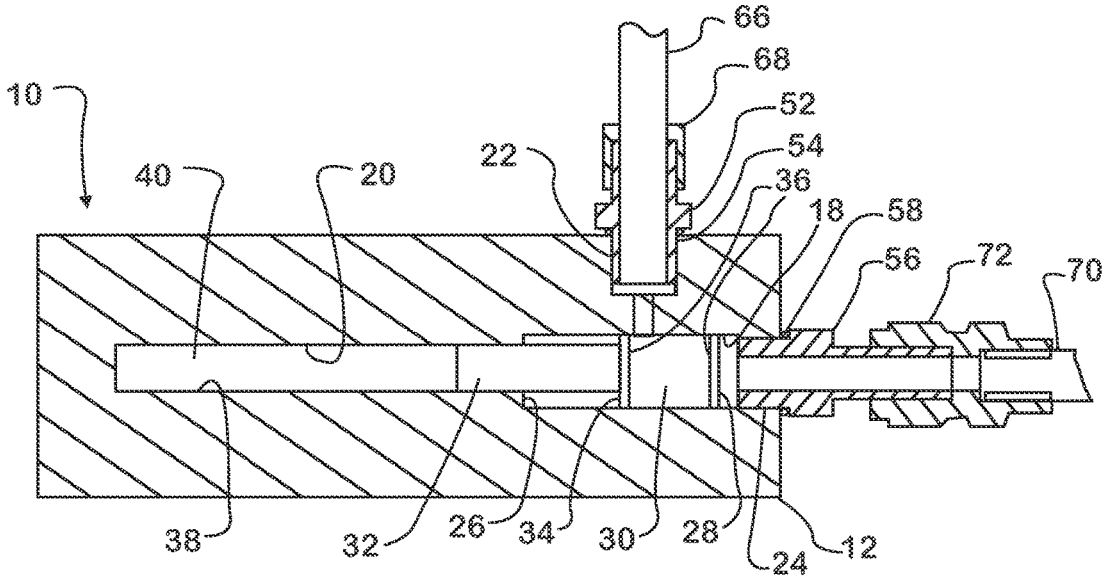
FIG. 4 is a cross section view in the direction of arrows 4-4 in FIG. 1.
Figure 5:
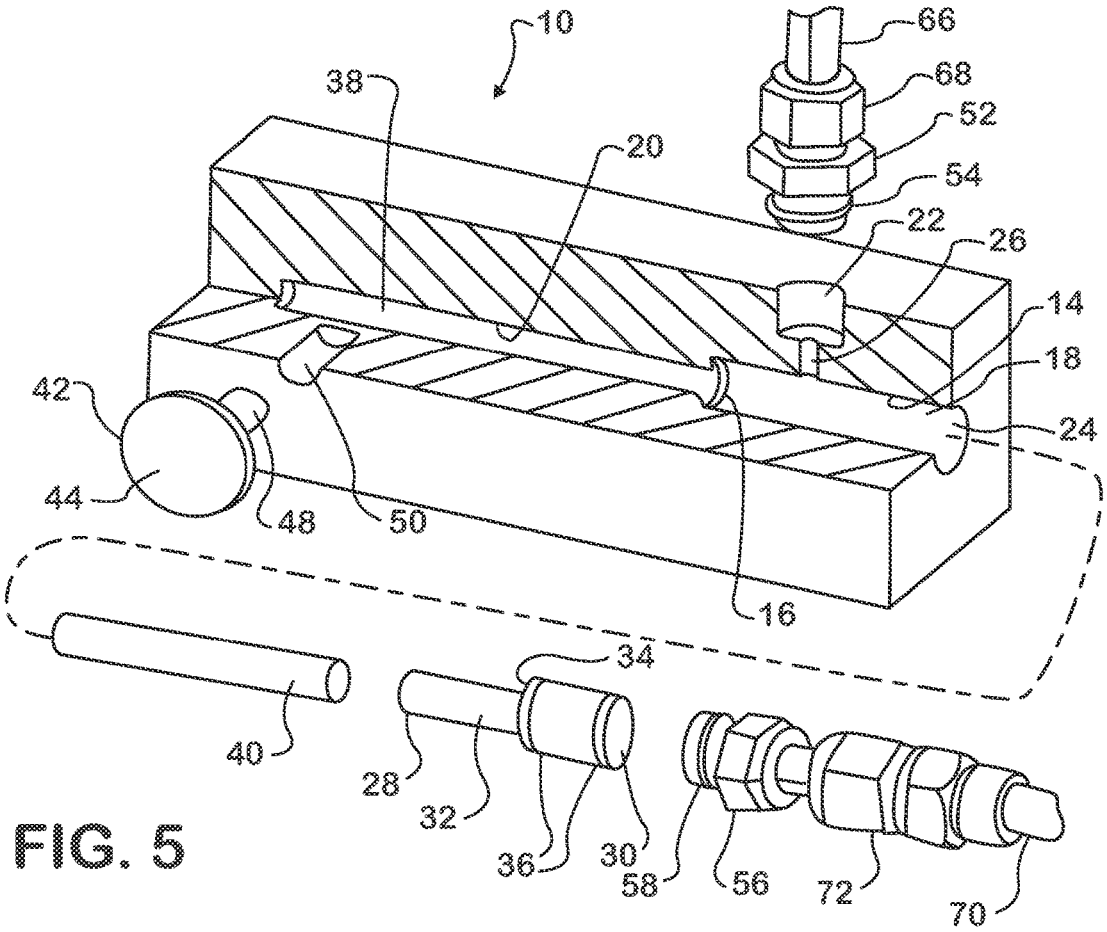
FIG. 5 is a perspective view like FIG. 2 but with portions exploded away.

With plunger 28 positioned inwardly beyond the location at which inlet passage 26 intercepts bore 14 relative to outlet port 24 as shown in FIGS. 2 and 3, delivery of thermal energy to element 40 from heater 44 via pump body 12 initiates thermal expansion of element 40 from an initial temperature to consequently force plunger 28 to move along bore 14 toward outlet port 24 because the diameter of element 40 is confined by cylindrical wall surface 20 of bore 14. Movement of plunger head 32 begins from within a first range of positions, and as long as plunger head 32 is within this first range of positions, plunger 28 allows fluid flow from inlet port 22 through inlet passage 26 into a portion of bore 14 between plunger head 32 and outlet port 24.

Continued thermal expansion of element 40 by heat transfer from heater 44 via pump body 12 then causes plunger head 32 to traverse the location at which inlet passage 26 intercepts bore 14, disallowing fluid flow from inlet passage 26 into bore 14. O-rings 36 now seal plunger head 32 to the wall of bore 14 to either side of inlet passage 26 along the length of bore 14. Once fluid flow from inlet passage 26 to bore 14 has been disallowed by plunger head 32, continued thermal expansion of element 40 forces plunger head 32 to move toward outlet port 24 along a second range of positions in larger diameter cylindrical wall surface 18 between outlet port 24 and the location at which inlet passage 26 intercepts bore 14, forcing fluid occupying the portion of bore 14 between outlet port 24 and plunger head 32 toward outlet port 24 while inlet passage 26 continues to remain between o-rings 36 as shown by the plunger head's position in FIG. 4.

For connecting fluid pump 10 as a gas reclamation pump in a gas reclamation system such as the one to be described in connection with FIG. 6, an inlet fitting 52 is threaded into inlet port 22 and circumferentially sealed against pump body 12 by an o-ring 54, and an outlet fitting 56 is threaded into outlet port 24 and circumferentially sealed against pump body 12 by an o-ring 58.

Figure 6:
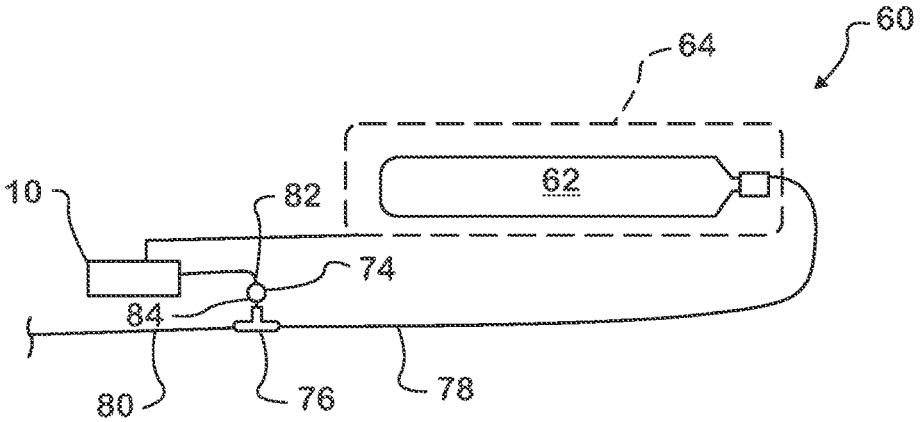
FIG. 6 is a diagram of a gas reclamation system containing the fluid pump shown in FIGS. 1 through 5.

FIG. 6 shows schematically a gas reclamation system 60 for reclaiming vent gas which has been vented from a gas storage vessel 62 into a vent gas vessel 64 which has a vent gas containment space. Gas storage vessel 62 stores a gas at super-atmospheric pressure and vent gas vessel 64 contains vent gas which has been vented from the gas storage vessel to prevent discharge of the vent gas to the surrounding atmosphere.

A gas reclamation system 60 is useful in a motor vehicle having a combustion engine operated by natural gas where natural gas is stored at super-atmospheric pressure as compressed natural gas (CNG) in a gas storage vessel 62 such a gas storage cylinder and delivered to the engine through a gas delivery system. Should pressure in the gas storage cylinder rise to a pressure limit, further pressure increase is limited by venting stored natural gas into vent gas vessel 64. Fluid pump 10 is operable to pump natural gas from vent gas vessel 64 back into gas storage vessel 62.

FIGS. 1-5 show a conduit 66 of gas reclamation system 60 connected at one end to inlet fitting 52 by a nut 68 and a conduit 70 connected to a nipple at one end to outlet fitting 56 by a union 72. An opposite end of conduit 66 is connected to vent gas vessel 64, and an opposite end of conduit 70 connects through a check valve 74 to a first port of a tee fitting 76 (FIG. 6) whose second and third ports are connected through respective conduits 78, 80 to gas storage vessel 62 and the fuel delivery system for the engine respectively.

Venting of gas storage vessel 62 to vent gas vessel 64 is accomplished in any suitably appropriate manner.

When vent gas is to be pumped from vent gas vessel 64 to gas storage vessel 62, fluid pump 10 is operated as explained earlier, with plunger 28 moving from the first range of positions to the second range of positions. As plunger 28 increasingly moves along the second range of positions, it increasingly compresses gas trapped between itself and an inlet 82 of check valve 74. When pressure of the trapped gas exceeds pressure at an outlet 84 of check valve 74 by a defined pressure difference, continued movement of plunger 28 forces some of the trapped gas back into gas storage vessel 62.

At some point, operation of heater 44 is discontinued. By fabricating pump body 12 from a thermally conductive metal, thermal energy transfer from element 40 through pump body 12 to the ambient environment can occur to cause the volume of element 40 to contract from its elastically expanded state with gas pressure in bore 14 returning plunger 28 to abut external shoulder 34 with internal shoulder 16.

Pump 10 can be repeatedly stroked by repeatedly turning heater 44 on and off.

Device 42 may be one which is capable of not only delivering thermal energy to plastic 40 as heater 42 does but also of drawing thermal energy from plastic 40. An example of such a device is a Peltier device.

Figure 7:
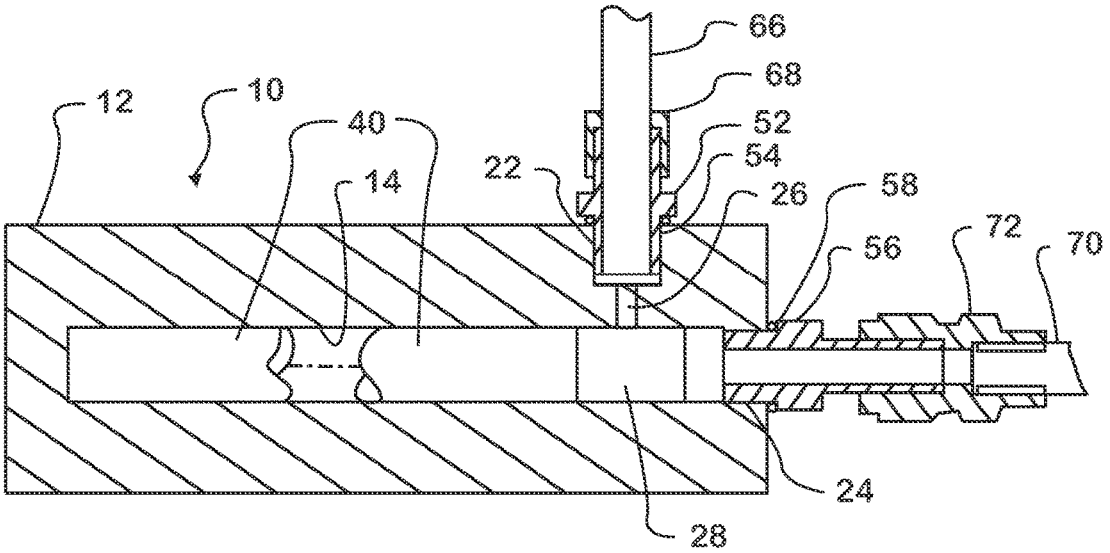
FIG. 7 is a view similar to FIG. 3 showing a modified form.
Figure 8:
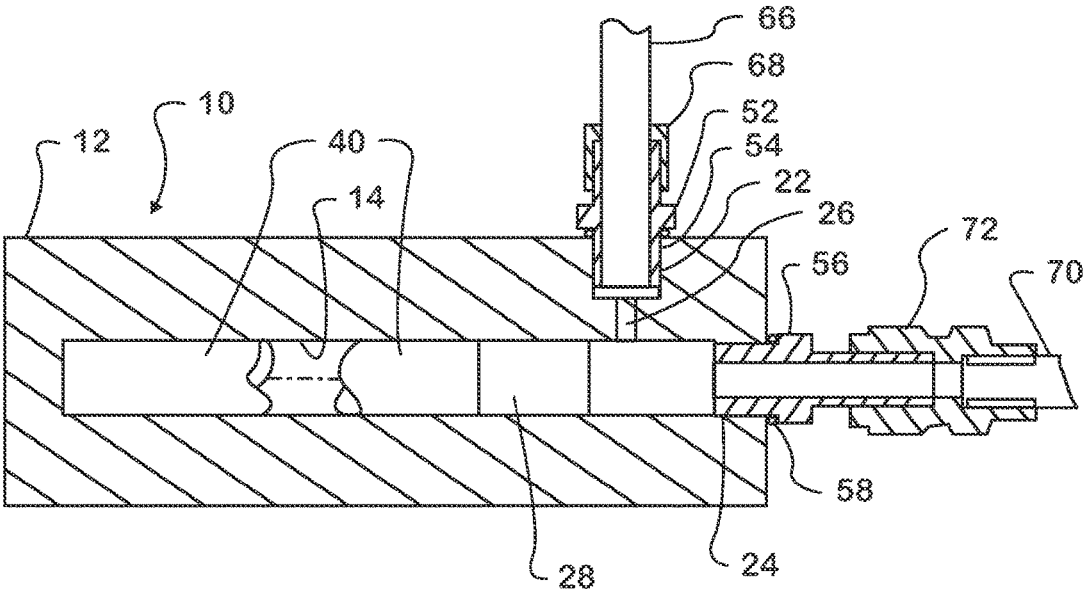
FIG. 8 is a view similar to FIG. 4 showing a modified form.

FIGS. 7 and 8 show a modified form of device 10 which is like the one shown in FIGS. 1-5 with the exception that bore 14 has no internal shoulder and instead has a common cylindrical diameter throughout variable volume space 38, the first range of positions, and the second range of positions. Plunger 28 has a common diameter which fits closely within bore 14. Plunger 28 also lacks o-ring sealing to the wall of bore 14 which is made possible by the selection of materials for pump body 12 and plunger 28. For example, pump body 12 may be fabricated from brass and plunger 28 from bronze. Different coefficients of thermal expansion for those two particular materials and proper sizing provide for a relatively looser sliding fit of the plunger at lower temperatures and a relatively snugger sliding fit of the plunger at higher temperatures.

The relative proportions and shapes of various pump parts shown in the Figures and the foregoing description of pump constructions should be construed as non-limiting examples.

Generically, element 40 can be any material which possesses a physical characteristic of volumetric expansion as difference between the element's actual temperature and an initial temperature increases. The difference between the element's actual temperature and its initial temperature may increase either positively or negatively, as explained earlier. Certain materials within the genus will expand and contract elastically. Certain materials will increase in volume as their temperature becomes colder while others will increase in volume as their temperature becomes warmer. In the disclosed application of pump 10 to CNG reclamation, an inexpensive plastic such as PVC for example can be used for element 40.

Because thermal expansion and contraction have relatively large time constants, the physical phenomenon of expansion of element 40 occurs at the molecular level and is capable of generating very large forces which are useful in compressing fluids to very high pressures. In the disclosed application of pump 10 to CNG reclamation, a slow cycle rate of the thermally operated pump is not a disadvantage. Pump 10 has a construction involving few parts which are readily available and/or can be economically manufactured by conventional methods.

What is claimed is:

1. A fluid pump comprising:

a pump body comprising a bore having an outlet port;

a plunger which is movable within the bore toward and away from the outlet port and which cooperates with a wall of the bore to define a variable volume space inward of the outlet port;

an element which occupies the variable volume space and whose volume increases with increasing difference between the element's actual temperature and an initial temperature;

the pump body further comprising an inlet port and an inlet passage coming from the inlet port to intercept the bore at a location which is traversed by the plunger during movement of the plunger within the bore;

and a device in thermal energy transfer relationship with the element, via the pump body, for causing the element to increasingly expand in volume with increasing difference between the element's actual temperature and an initial temperature, and to increase the volume of the variable volume space by forcing the plunger to move along the bore toward the outlet port, wherein the plunger is beyond the location at which the inlet passage intercepts the bore relative to the outlet port for allowing fluid flow from the inlet port through the inlet passage into a portion of the bore between the plunger and the outlet port, then traverses the location at which the inlet passage intercepts the bore for disallowing fluid flow from the inlet passage into the bore, and then moves toward the outlet port to a portion of the bore between the outlet port and the location at which the inlet passage intercepts the bore while continuing to disallow fluid flow from the inlet passage into the bore, thereby forcing fluid, which occupies a portion of the bore between the outlet port and the plunger, toward the outlet port;

wherein the pump body comprises a thermally conductive metal, the device in thermal energy transfer relationship with the element via the pump body comprises an electric heater mounted on the pump body for delivering thermal energy to the element via the pump body, the element comprises material whose volume elastically increases as its actual temperature increases from the initial temperature, and the pump body is disposed in an ambient environment, which is effective to cause thermal energy transfer from the element through the pump body to the ambient environment, thereby decreasing the volume of the element upon the electric heater ceasing to deliver thermal energy to the element via the pump body after having delivered thermal energy to the element via the pump body to increase the volume of the element.

2. The fluid pump as set forth in claim 1 further including a check valve having an inlet open to the outlet port and an outlet, the check valve disallowing flow from its outlet to its inlet and allowing flow from its inlet to its outlet when pressure at its inlet exceeds pressure at its outlet by a defined pressure difference.

3. The fluid pump as set forth in claim 1 wherein the pump body comprises a blind passage extending from an exterior surface of the pump body toward the element, and a portion of the device is disposed within the blind passage.

4. The fluid pump as set forth in claim 1 wherein the inlet passage perpendicularly intercepts the bore.

5. The fluid pump as set forth in claim 1 wherein the bore comprises an internal shoulder which faces the outlet port and is located beyond the location at which the inlet passage intercepts the bore relative to the outlet port, the plunger comprises a cylindrical stem and a cylindrical head forming an external shoulder facing the internal shoulder of the bore to define an inward limit of plunger movement away from the outlet port when the plunger is moving within the first range of positions away from the outlet port and the external shoulder abuts the internal shoulder, and the bore comprises a smaller diameter cylindrical wall surface within which the plunger stem moves and a larger diameter cylindrical wall surface within which the plunger head moves.

6. The fluid pump as set forth in claim 1 wherein the bore comprises a common cylindrical diameter throughout the variable volume space.

* * * * *